US005524658A

United States Patent [19]

Schrader

[11] Patent Number: 5,524,658

[45] Date of Patent: Jun. 11, 1996

[54] SIT TO STAND HINGED SEAT WALKER WITH PULL-UP HANDLE

[76] Inventor: Joseph F. Schrader, 22 Pearl St., New Hartford, N.Y. 13413

[21] Appl. No.: 288,783

[22] Filed: Aug. 12, 1994

[51] Int. Cl.[6] ..... A61H 3/02

[52] U.S. Cl. ..... 135/72

[58] Field of Search ..... 135/65, 66, 67, 135/68, 69, 72; 297/5, 6; 623/27, 28, 29, 30, 31, 32

[56] References Cited

U.S. PATENT DOCUMENTS

| | | | |
|---|---|---|---|
| 2,827,897 | 3/1958 | Pawlowski . | |
| 4,254,948 | 3/1981 | Jacobs | 297/5 X |
| 4,641,882 | 2/1987 | Young | 297/5 X |
| 5,178,595 | 1/1993 | MacGregor . | |

FOREIGN PATENT DOCUMENTS

| | | | |
|---|---|---|---|
| 2611492 | 9/1988 | France | 135/68 |
| 4034755 | 5/1992 | Germany | 135/67 |
| 2012315 | 5/1994 | Russian Federation | 135/69 |

*Primary Examiner*—Carl D. Friedman

*Assistant Examiner*—Yvonne Horton-Richardson

*Attorney, Agent, or Firm*—Sughrue, Mion, Zinn, Macpeak & Seas

[57] ABSTRACT

A planar seat support of generally V-shaped configuration is pivoted at an apex end to a side of an upstanding support post and includes a narrow width handle section to the front and above a planar seat, which is pivotably mounted to the upper edge of an opposite side seat support section of the seat support. The seat is mounted for limited pivoting with respect to the seat support to facilitate strapping of the walker to the thigh and leg of an afflicted limb of the user with the user in sitting position. A second handle section is integral with the post and extends upwardly therefrom to the side of the seat support, and the first and second handle sections terminate in oppositely directed tubular handles. Grasping of the handle carried by the support post after strapping of the walker to the user's thigh and leg permits the user to easily raise himself to an upright standing position while remaining seated on the seat. The seat support locks in the position with the seat generally horizontal and overlying the upstanding post. A spring biased plunger carried by a tubular handle portion of one handle, section engages the other handle section tubular handle portion to lock the two handles in axially aligned side-by-side position.

11 Claims, 2 Drawing Sheets

SIT TO STAND HINGED SEAT WALKER WITH PULL-UP HANDLE

FIELD OF THE INVENTION

This invention relates to walker to assist ambulation of persons having leg or foot injuries, and more particularly to a walker which permits the user to straddle a flat planar seat which may be pivoted from a generally horizontal position overlying a vertically upright post, to an upwardly oblique lowered position at an angle with respect to the post to facilitate the user mounting on the walker and strap coupling of the thigh and leg of the user to various components of the walker.

BACKGROUND OF THE INVENTION

Upon injury to the leg, knee or foot, the injured limb is typically put in a soft or hard cast or splint to render the injured portion of the leg or foot generally immovable. Typically, such injured person walks with the aid of a cane or crutches or is confined to a wheelchair or the like while provided with limited mobility.

Medical devices have been developed to better facilitate ambulation. U.S. Pat. No. 2,827,897, issued Mar. 25, 1958 to Zygunta Pawloski and entitled "ARTICULATED LEG BRACE" is directed to an articulated leg brace which extends from the thigh to the foot of the user for supporting the injured leg and which snugly engages and supports the person's thigh, as well as the kneecap to distribute the load uniformly over a large area while the user is walking and sitting. The structure is quite complicated, employs a curved elongate member which conforms to and is strap mounted to the underside of the thigh of the user, extends on one leg substantially from the hip to the knee, utilizes a rod telescopically secured to a post and pivotably connected to multiple struts and employs additionally a pair of brace members pivotably secured to the U-shaped member strapped beneath the thigh. During walking, several members form a vertically upright post, lock into vertically upright aligned positions to facilitate ambulation.

U.S. Pat. No. 5,178,595, issued Jan. 12, 1993 to Douglas MacGregor and entitled "WALKING DEVICE TO ASSIST THOSE WITH AN INJURY TO A LOWER LIMB", also employs a vertically upright post member having respective upper and lower respective thigh and leg receiving members of channel shape which are strapped about the thigh and leg to permit the injured limb to bear the weight of the user and thus the load in compression rather than in sheer.

Such devices eliminate the need for crutches but are quite difficult for older people or people with weight problems to rise into an upright position after putting on such walking devices. Indeed, doctors for years have been reluctant to prescribe crutches for people who are injured in their later years due to lack of upper body strength, poor balance and the practical inability to stand from a sitting position and then place crutches under their arms.

It is therefore an object of this invention to provide an improved sit to stand hinged seat type walker with a pull-up handle to facilitate attachment of the walker to the injured limb of the body, particularly of users having limited upper body strength, poor balance or other difficulties when attempting to stand from a sitting position, which is comfortable in ambulation, which supports the weight of the user while straddling a seat in normal horizontal position perpendicular to the axis of the walker post when vertically upright.

It is a further object of the invention to provide such sit to stand hinged seat walker with a pull-up handle, readily graspable by the user and whose flat seat is rotatable from a horizontal position with the post upright to a lowered, upwardly oblique position to the rear of the handle to permit ready coupling of the thigh and leg of the user to hinged components of the walker.

SUMMARY OF THE INVENTION

The walker of this invention provides an inexpensive, simplified structure consisting essentially of a vertically upright support post, a seat support pivotably mounted to the post, a planar seat mounted to the seat support above the pivot connection to the post and extending generally perpendicular to the plane of the seat support when in a first position horizontally overlying the support post. A raised handle is fixedly mounted to the post in front and above the seat and extends across the seat. Means are provided for locking the seat support in a position with the seat raised and horizontally overlying the upper end of the post while permitting the seat support when unlocked to rotate such that the seat is in a lowered, upwardly oblique position to allow the user to straddle the seat with his knees bent, while in sitting position. With the user's thigh and leg of the afflicted limb strapped to respective hinged components of the walker, the raised handle may be grasped by the user and the user may effectively raise himself with reaction forces taken up by the bottom of the post in contact with a floor or other underlying support surface. This permits the user straddling the seat to gently move from seated position to an upright standing position with the walker strapped to the afflicted limb and bearing the load.

The handle means may comprise a first handle section fixed to the upper end of the post and extending upwardly therefrom, and a second handle section fixed to the seat support and extending upwardly therefrom and movable into side to side alignment with the first handle section. The first and second handle sections may protrude outwardly from the longitudinal center line of the walker to respective opposite sides of the seat. Preferably, the seat is of hour glass planar form to facilitate the user in straddling the planar seat when mounting the walker and while in upright walking position, such that the full weight of the user's body can be borne the vertically upright post. Preferably, both handles are of tubular form and a locking pin carried by a bore of one of the tubular handle sections is spring projected into a bore of the other tubular handle section, thereby locking the locking seat support in a first position with the planar seat horizontal and overlying the upper end of the post. A coil spring, having one end fixed to the post and the other end fixed to the pivotable seat support and coiled about a pivot pin or bearing pivotably coupling the seat support to the post, functions to spring bias the seat support rotationally from the second position to the first position, so there is no need to pull up the seat support and seat during the rising of the user from a knee bent, user sitting up position to a vertically upright, user standing position. Preferably, the planar seat is pivotably coupled to the upper end of the post for pivoting through a limited rotation relative to the post so as to facilitate the attachment of the thigh and leg of the afflicted limb to the seat support and the post, respectively, with the knee of the user bent. Further, the post may terminate at its lower end in an adjustable height leg member connected to the post proper by a series of bolts and nuts so that the walker may be usable by afflicted persons of varying height.

BRIEF DESCRIPTION OF THE DRAWINGS

The best mode for carrying the applicant's invention is illustrated in the accompanying drawings, in which.

DESCRIPTION OF THE PREFERRED EMBODIMENT

Figure 3:
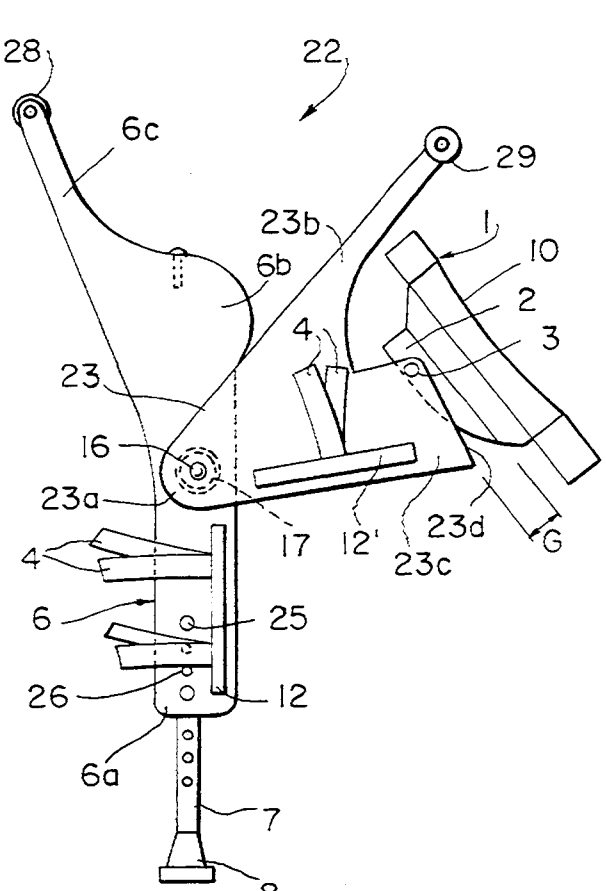
FIG. 3 is a side elevational view similar to that of FIGS. 1 and 2, with the seat support pivoted to a second position in which the planar seat is upwardly and rearwardly oblique relative to the post, permitting the device to be attached to the user's leg and thigh while seated and prior to the user rising to a vertically upright, standing position by pulling on the handle of the first handle section.

Referring to the drawings, the improved sit to stand hinged seat type walker with pull-up handle is illustrated generally at 22 and is comprised principally of a walker post or main support 6, a generally V-shaped seat support 23 pivotably mounted to one side of the post 6, with both members being formed of sheet metal or wood or the like, a flat planar seat 1, preferably of hour glass plane configuration and being pivotably mounted to the seat support 23, and a front or forward pull-up handle means indicated generally at 24, at least a portion of which is integrated with the seat support 23.

The post 6 includes at a lower end **6*a* a height adjustable leg indicated generally at 7, which may be constituted by a tubular metal member formed of aluminum or a metal strip bearing a plurality of holes 26 spaced over its length and which selectively receive nuts and bolts indicated at 25 which also extend through a similarly spaced row of similarly sized holes 26 within the post 6 at at least two locations. The purpose of this is to vary the overall height of the post 6 and thus the vertical position of the seat 1 relative to a rubber foot 8. The rubber foot may be of cup shape and frictionally gripping the lower end of the tubular leg 7. Alternatively, the adjustable leg and the post 6** may be of telescopic form similar to that of U.S. Pat. No. 5,178,595.

The seat support 23, which may be also formed of sheet metal, is of generally V-shape having integrally a lower apex portion **23*a*, an upwardly and forwardly narrowing, second handle section 23*b*, and a rearward, relatively wide seat support section 23*c*. As seen best in FIGS. 2 and 3, the post 6 terminates at an upper end 6*b*, which is somewhat enlarged in width and rounded, being of a height so as to underlie a flat stop 2 of seat 1. A pivot pin 3 pivotably connects the seat 1 to the seat support section 23*c* of the V-shaped seat support 23. A first handle section 6*c* of a width and configuration similar to that of the second handle section 23*b* of the seat support 23 projects upwardly and forwardly of the vertical axis A of the post 6 and carries, at the end of the post, a first handle section tubular handle 28, which projects rearwardly in drawing FIGS. 1, 2 and 3 and to the left as seen in FIG. 4. This complements a similar sized, tubular handle portion 29 which projects to the right and which is integral with the seat support 23. The handle sections define a split handle indicated generally at 30, FIG. 4. A pivot coupling is effected between the apex portion 23*a* of the V-shaped seat support 23 with the side of the post 6 via a pivot joint 16 consisting of bearing and locking NYLOCK® nuts. Such pivot coupling, which is lockable in a desired first position, as for instance in FIG. 1 with the seat 1 horizontal and overlying the upper end 6*b* of the post, may be facilitated by various other bearing and lock members which are well known. Such a pivotable lock between hinged members, which members may be shifted from in line position where the members are locked to a angularly displaced position, are readily seen in U.S. Pat. No. 2,827,897 in FIGS. 7 and 8**.

The bearing may be effected by a pin fixed to the side of the post 6 and extending outwardly therefrom and received within a circular hole carried by the seat support 23. Integrated to the pivot joint 16 is a biasing means comprised of a coil spring 17 having one end fixed to the post 6 or a stud or pin carried thereby, and the other end fixed to the pivotable seat support and being spiral wrapped so that a spring is stretched during pivoting from the position shown in FIG. 1 to that of FIG. 3. Thereafter, upon rising of the user from a sitting position, after strapping on the device 22 as per FIG. 3, the seat support and seat 1 move from an oblique position by the bias of the coil spring 17 back to the position shown in FIG. 1 where the seat takes a generally horizontal position at right angles to the vertical axis A of the post 6.

Preferably, the handle means 24 includes a locking system indicated generally at 18 and consisting of a spring coil biased plunger or pin 31, whose headed end **31*a* may be retracted against the bias of the spring and having a projectable end 31*b* which passes through the post 6 and projects within a bore 32 within the handle portion 23*b* of the seat support 23 so as to lock the seat support 23 to the facing side of the post 6 as per FIG. 4. As may be appreciated, other locking means may be employed to maintain the alignment of the axes of the tubular handle portions 28, 29 of the split handle 30 when in the position of FIG. 4. Such handle portion to handle portion locking may be assisted by further locking means incorporated within the pivot connection 16 between the apex 23*a* of the seat support and post 6. While the lockable hinge means at 16 may function adequately, however, the lock between the handle portions 28 and 29 at the extreme end of the first and second handle sections 6*c*, 23*b* minimize the stresses on the locking mechanism during pull-up of the user from seated position to upright, standing position in the sequence from FIGS. 3–1 during use of the walker 22**.

Figure 2:
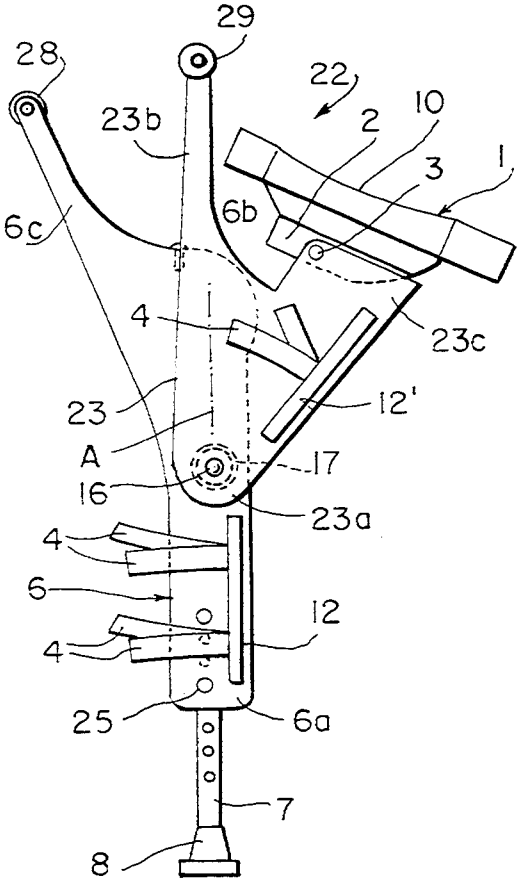
FIG. 2 is a similar side elevational view to that of FIG. 1, with the seat support bearing the seat pivoted rearwardly to some degree and illustrating first and second handle sections of the walker, respectively, as part of the post and seat support.
Figure 1:
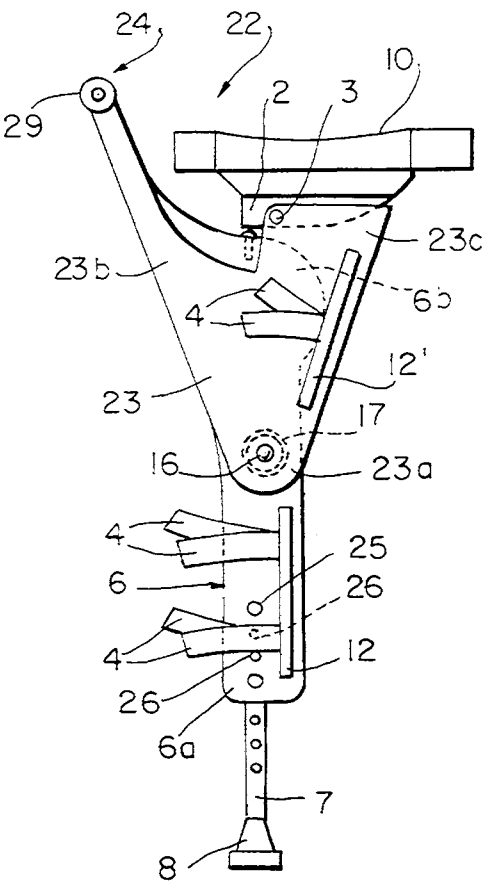
FIG. 1 is a side elevational view of the walker in a position for use with the seat horizontal and overlying the vertical upright post.
Figure 5:
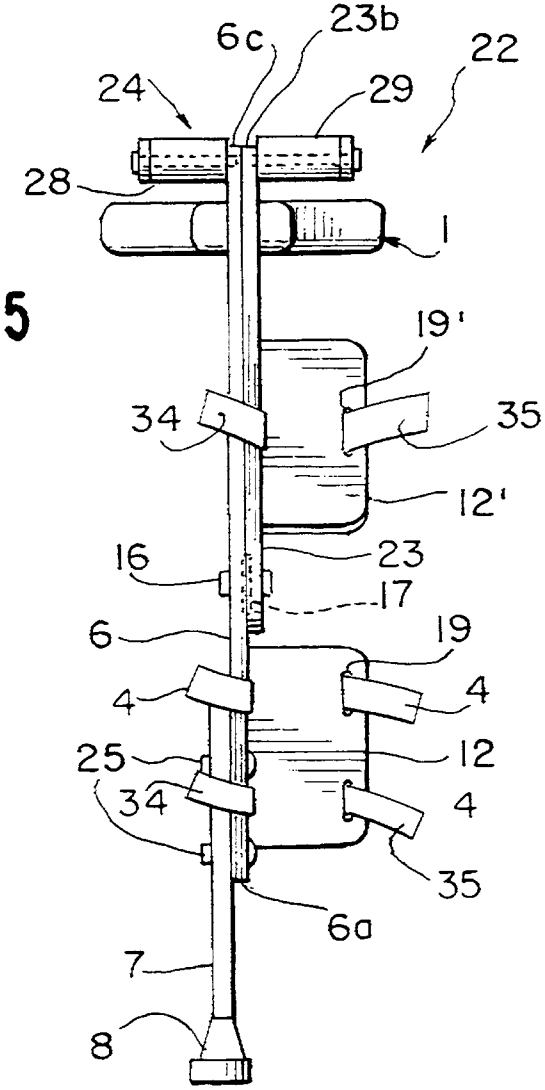
FIG. 5 is a front elevational view of the walker of FIGS. 1–4.
Figure 4:
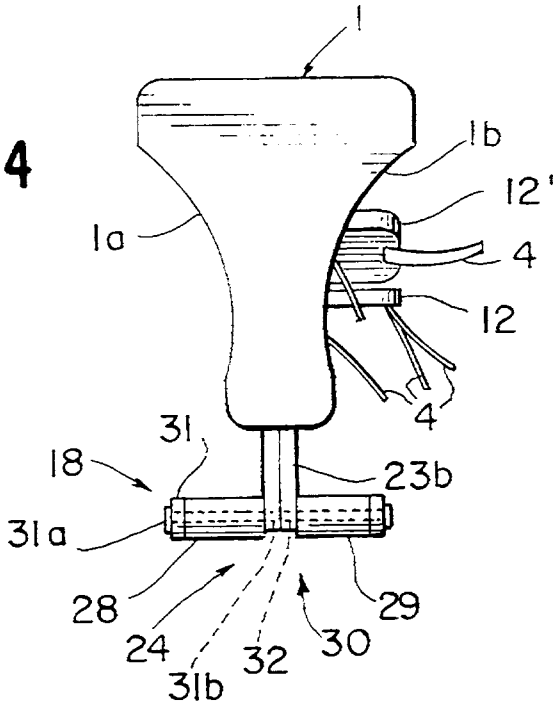
FIG. 4 is a top plan view of the walker of FIG. 1.

It is noted in FIGS. 1–3 that the placement of the pivot pin 3 at the edge of the seat support section **23*c* of the seat support 23 at the forward end thereof permits the slight inclination or angulation of the seat relative to the flat stop 23*d* at the top of the seat support section 23*c*. Indeed, the angulation of the seat 1 relative to the support 23 as seen in FIG. 3 is limited to an angle of less than 10°, providing a gap G at the rearward edge of the stop 23*d* which facilitates the attachment of the walker to the person or user at the thigh and leg as will be described hereinafter with the user in a sitting position during effecting of that attachment, all in accordance with FIG. 3**.

In the instant walker 22, the post 6 has fixedly mounted to the exterior face of the post 6, as per FIGS. 1–3 and 5, a flat, planar leg plate 33, which may be vertically in line with axis A of the post 6 or which may be angled obliquely with respect thereto. A second thigh plate 12' is fixedly mounted to the exterior face of the seat support 23, FIG. 5, and extends at right angle outwardly therefrom. The thigh plate is flat and may be angled slightly with respect to the plane of leg plate 12. With the user straddling the seat 1 and with the thighs of the user extending within the curved recesses 1*a*, 1*b* of the hour glass shaped seat 1, the afflicted limb is positioned to the side of the device 22 bearing the thigh plate 12' and the leg plate 12. Leg plate 12 includes a pair of vertically spaced slots 19, through which pass VELCRO® coupling straps 4. Thigh plate 12' includes a pair of spaced slots 19' for receiving similar coupling straps 4. Such hook and loop type material fastening system in itself is notoriously old as evidenced by U.S. Pat. No. 5,178,595, however, they are quite effective. The straps 4, which may be four in number, two for the thigh plate and two for the leg plate, have their free ends passing through the slots 19', 19 for respective plates 12', 12. Alternatively, the slots 19, 19' may be formed within the post 6 adjacent to the inside edge of the plates 12, 12'. The opposite ends of the straps preferably are provided with a flat ring through which the free ends of the VELCRO® opposite type loop and hook material strips pass. The outside face of the straps adjacent to the flat rings (not shown) may be provided with a short length strip of hook like material. The inside face of the straps, over the major length or all of the length, may be provided with a strip 35 of opposite type loop material. After the free ends of the straps are passed through the flat rings, the straps are tightened down over the thigh or leg, as the case may be, and after tightening the inside loop material strip 35 is brought into contact with the hook type material strip 34 adjacent to the flat ring on the exterior surface of the strap, where detachable locking is effected between the opposite type material portions of the straps. Alternatively, the opposite type hook and loop material fastening system sold under the registered trademark VELCRO® may take different forms from that described herein and illustrated in the drawings. Further, while the thigh and leg plates are shown as flat plates, they may be curved in their longitudinal directions and/or curved in cross-section as illustrated in U.S. Pat. No. 5,178,595. Further, the adjustable strap system permits the straps to be employed on user's whose legs are thin, thick or whose legs may be deformed. Additionally, the straps facilitate the attachment of the device to the afflicted limb of the user irrespective of whether the user's thigh or leg is within a soft or hard cast.

After strapping of the plates 12 and 12', respectively, to the leg and thigh of the afflicted limb, with the user's knee bent to conform to the split, open position of the seat support 23 relative to the post 6, the user may readily pull himself from the sitting position to the standing position while seated on seat 1 by reversing the sequence of FIGS. 1–3. The seat 1 may be rounded and/or padded and may be appropriately sized and padded to the individual user.

During use, the user's gluteus maximus rests in the area of the seat, with the crotch of the user straddling the seat and the thighs extending downwardly within the opposite side recesses 1*a*, 1*b*. The top of the seat 1 may also have a shallow recess 10 within the seat proper or its pad as per FIGS. 1–3. Further, the seat support 23 as well as the post 6 may have handle sections which are of varying lengths dependent upon the needs of a particular user. In terms of the VELCRO® strap system, the leg and thigh plates 12, 12' may have one or more surfaces thereof directly covered with one of the loop and hook material strips to facilitate strapping in of the afflicted limb to a respective plate.

As may be appreciated, the components of the walker may be formed of sheet metal, wood, or plastic, assuming they have the strength of rigidity to perform their functions as described above. The walker is of simplified construction and eliminates the difficulty of many aged and physically weak users who have great difficulty in bending over from a standing position to strap the afflicted limb via the straps to the leg and thigh plates or leg supports incorporated into the pivotable elements of the walker 22. The invention provides a comfortable seat facilitating the transfer of the weight from the user through the walker 6 to the underlying rigid support surface such as a floor or the like. The user straddles the seat and is fully supported thereon, with the post vertically upright and underlying the seat while in a horizontal, locked position. Further, the seat 1 permits the user to rise up easily, much like a modern window unit that allows the weight of the glass and frame to work with a light touch. The walker permits the apparatus to be easily attached to the afflicted limb while the user is in a seating position. After strapping on the walker, the user may readily use one or both of the split handles to pull himself or herself to a standing position, even when such person has little body strength. Automatic seat locking is effected in a seat raised position, preferably via a spring biased pin connection between the sectioned handles 28, 29. Further, by a mere axial pull on the spring biased pin 31, unlocking may be effected at the handles by the user so that the user can momentarily sit without the necessity to remove the walker while the walker is ready to be used at will by the simple expedient of rising from the sitting position with the seat in contact with the buttocks of the user and rising therewith.

Preferably, the stop under the seat prevents the seat from tilting all the way forward. While the illustrated embodiment employs an adjustable bolt and locking nut as a stop, a wooden stop may be substituted therefor. Without the pivoting stop, the user has a tendency to step too far forward and to walk too fast during ambulation. Further, a seat with a stop is more comfortable to sit on when the user is not in motion and resting on the seat. Walking is therefore stabilized and the user additionally is quite capable of standing and using one's hands while in the sitting position.

As may be appreciated, there are significant physical benefits to the user by use of the walker in the form shown and described. The user is capable of walking at a near normal pace with little fatigue while using considerably more muscles than that normally used using a crutch. This helps speed recovery because the muscles are being used in a walking motion and there is less atrophy.

With the seat supporting the weight on gluteus maximus, not only is the strain relieved on the upper body, but such relief assists users suffering from bursitis in the shoulders, users with weak upper body strength or users having lower back problems.

The walker of the invention functions to support the injured limb and acts as a splint to protect the limb from unwanted movement. It may be also used to support a cast while taking the weight of the cast off the user's thigh and hip. With the sit to stand, hinged seat walker in use centered between both legs, unlike crutches and canes which are to the outside of the user, there is less tendency of the user to slip on the surface during ambulation. The handles are used to further control the walker and to improve the stability of the walker during ambulation. The sit to stand, hinged seat walker of the invention not only assists ambulation, but leads to improved bone growth, improved circulation, a reduction in bladder infections, a reduction in pressure sores and the prevention of contractures. Such action is in ready contrast to a user employing crutches, which takes roughly twice as much energy for the person to walk with crutches as is required for an able-bodied person to walk normally. In essence, the crutch user is doing an off-the-floor pushup with every step. Even a highly physical fit person has trouble with the crutch regimen. The sit to stand, hinged seat walker of this invention allows a user to move about with much less physical effort than such user employing a crutch or a pair of crutches.

It should be understood that while the invention has been described in detail with respect to a preferred embodiment, various changes and modifications may be made from the foregoing without departing from the spirit and scope of the appendant claims.

I claim:

1. A sit to stand hinged seat walker comprising:

a elongated upstanding support post having an axis, a seat support pivotably mounted to said post for rotation about an axis perpendicular to the axis of said post, a planar seat mounted to a top of the seat support for movement between a first position horizontally overlying the top of said post and a second rearward, lowered and oblique position, a raised handle fixedly mounted to said post and extending horizontally across the front of said seat when in said horizontal position overlying the top of said post, means for releasably locking said seat support with the seat in said first position, whereby upon release of said locking means, said seat support may be rotated to a lowered, upwardly oblique second position rearwardly of said handle to allow a user to straddle the seat with the user's knees bent while in user sitting position, and means carried by said seat support and said post for strapping said walker to the affected limb with the user seated on said planar seat, whereby said user by pulling on said handle may easily raise himself upwardly with the seat from said second, user sitting position to said first, user standing position and during ambulation, the user is able to walk at a near normal pace with little fatigue, thereby speeding recovery, since the muscles are being used in a walking motion with less atrophy, while the seat supports the weight of the user's gluteus maximus relieving strain on the upper body and with the seat centered between both legs, stability is improved and there is significantly less tendency for the user to slip while using the walker during ambulation, with the assisted ambulation leading to improved bone growth, improved circulation, reduced bladder infections, reduced pressure sores and prevention of contractures.

2. The walker as claimed in claim 1, further comprising spring biasing means for biasing said seat support rotatably into said first seat position from said seat second position during rise of the user from a knee's bent position to an upright standing position.

3. The walker as claimed in claim 1, wherein said planar seat is pivotably mounted to said seat support at a front edge thereof proximate to said raised handle, allowing a rear edge of said seat to pivot away from the seat during movement of said seat support from said first position to said second position.

4. The walker as claimed in claim 3, further comprising means carried by said post for engaging said hinged seat for limiting pivoting of said hinged seat relative to said seat support when said seat is in said first position.

5. The walker as claimed in claim 1, wherein said handle means comprises a first handle section fixed to said post and a second handle section fixed to said seat support, and wherein said handle sections have respective handle portions fixed thereto and extending outwardly therefrom to opposite sides of said walker and in selective axial alignment.

6. The walker as claimed claim 5, wherein said means for locking said seat support in said first position comprises locking means carried by one of said handle portions and selectively operatively engaging the other handle portion of said other handle section.

7. The walker as claimed in claim 5, wherein said post and said seat support are planar members and are pivotably mounted together side-by-side such that said handle sections extend parallel to each other in face-to-face position with said seat in said first position.

8. The walker as claimed in claim 5, wherein said support post includes a vertically upright section having a lower end contactable with an underlying support surface and said first handle section extends upwardly and forwardly of said seat to accommodate said seat when in the first horizontal position overlying the upper end of said post.

9. The walker as claimed in claim 5, wherein said seat support is generally of V-shape in side elevation having a lower apex at the pivot connection between said seat support and said post, a relatively wide seat support section pivotably mounting said seat at an upper end thereof and a relatively narrow second handle section extending upwardly and outwardly thereof and terminating at a height in excess of the height of said seat support section.

10. The walker as claimed in claim 5, further comprising a pivot seat adjustment locking bolt mounted to the upper end of said post and in a position for abutment with a bottom of said seat, thereby adjustably defining the pivot position of said seat with respect to said seat support when said seat is in said first position.

11. The walker as claimed in claim 3, wherein said seat support comprises a thigh plate fixedly thereto and extending outwardly thereof at right angles to the seat support, and said post includes a leg plate fixedly mounted thereto and extending outwardly of said post at right angles to the same side thereof as said thigh plate, and wherein said means for strapping said afflicted limb of the user to said walker comprises strap means carried by said thigh plate and said leg plate for strapping a thigh and a leg of said afflicted limb to respective faces of said thigh plate and said leg plate.

* * * * *